US010822803B1

(12) United States Patent
Inzeo et al.

(10) Patent No.: US 10,822,803 B1
(45) Date of Patent: Nov. 3, 2020

(54) EXPANSION JOINT HAVING THREE AXES OF EXPANSION

(71) Applicant: Metal-Era, Inc., Waukesha, WI (US)

(72) Inventors: Joseph A. Inzeo, West Allis, WI (US); Karey Wiefelspuetz, Waukesha, WI (US); Michael D. Feltz, Waukesha, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 16/580,170

(22) Filed: Sep. 24, 2019

(51) Int. Cl.
*E04D 13/15* (2006.01)

(52) U.S. Cl.
CPC ..... *E04D 13/151* (2013.01)

(58) Field of Classification Search
CPC ..... E04D 13/151
See application file for complete search history.

(56) References Cited

U.S. PATENT DOCUMENTS

| | | | | |
|---|---|---|---|---|
| 3,296,762 | A * | 1/1967 | Thom | E04D 13/1415 52/395 |
| 3,421,267 | A * | 1/1969 | Reiff | E04D 13/1415 52/58 |
| 3,425,172 | A * | 2/1969 | Attaway | E04D 13/1415 52/58 |
| 6,237,293 | B1 * | 5/2001 | Gembala | E04D 13/0431 52/302.6 |
| 2012/0117900 | A1 * | 5/2012 | Shaw | E04B 1/948 52/232 |

* cited by examiner

*Primary Examiner* — Andrew J Triggs
(74) *Attorney, Agent, or Firm* — Donald J. Ersler

(57) ABSTRACT

An expansion joint having three axes of expansion for roof to wall and roof to roof applications. An expansion joint with roof to wall applications preferably includes a continuous cleat, a curb rail, a condensate seal, a formed cap, a sliding surface plate and a plurality of retainer plates. The continuous cleat slides vertically relative to a wall and horizontally relative to a roof curb. The continuous cleat slides vertically relative to the formed cap. An expansion joint with roof to roof applications preferably a continuous cleat, a formed cap, a curb rail, a Z-curb rail, a condensate seal and a plurality of retainer plates. The continuous cleat slides vertically relative to a fixed curb wall and horizontally in two axes relative to a free roof curb.

7 Claims, 18 Drawing Sheets

EXPANSION JOINT HAVING THREE AXES OF EXPANSION

BACKGROUND OF THE INVENTION

1. Field of the Invention

The present invention relates generally to roofing and more specifically to an expansion joint having three axes of expansion for roof to wall and roof to roof applications.

2. Discussion of the Prior Art

It appears that the prior art does not disclose expansion joints that expand in three axes for roof to wall and roof to roof applications.

Accordingly, there is a clearly felt need in the art for an expansion joint having three axes of expansion for roof to wall and roof to roof applications.

SUMMARY OF THE INVENTION

The present invention provides an expansion joint having three axes of expansion for roof to wall and roof to roof applications. An expansion joint having three axes of expansion for roof to wall applications (roof to wall expansion joint) preferably includes a continuous cleat, a continuous curb rail, a condensate seal, a formed cap, a sliding surface plate and a plurality of retainer plates. The continuous cleat includes a base member, an upward member and a downward member. A plurality of expansion openings are formed through the base member. The upward member extends upward from one edge of the base member and the downward member extends downward from an opposing edge of the base member. A plurality of vertical expansion slots are formed in the upward member. The downward member preferably includes a first downward portion, an offset portion and a second downward portion. The first downward portion extends downward from the opposing edge of the base member. One end of the offset portion extends downward from a bottom of the first downward portion and a top of the second downward portion extends downward from a bottom of the offset portion. The continuous curb rail includes a curb base member, a first downward turned flange and a second downward turned flange. The first downward turned flange extends downward from a first side of the curb base member and the second down turned flange extends downward from a second side of the curb base member.

The condensate seal includes a seal base, a curb member, an insulation member and a wall member. The wall member extends upward from one side of the insulation member and the curb member extends upward from an opposing side of the insulation member. The seal base extends outward from a top of the curb member. A formed cap includes a cover plate, a side plate, a retention flange and an attachment flange. The cover plate extends upward from a top of the side plate at an acute angle. The retention flange extends upward from a bottom of the side plate. The second downward portion is retained between the retention flange and the side plate. The attachment flange extends vertically upward from a top of the cover plate. For outer corner applications, a side flange extends perpendicular from one end of the side plate; a cover flange extends perpendicular from one end of the cover plate; and an attachment flange extends perpendicular from one end of the attachment flange. The sliding surface plate includes an angled flange that extends outward from a bottom thereof. Each retainer plate includes opposed angled flanges that extend outward from opposing edges thereof.

The roof to wall expansion joint is preferably installed as follows. The curb member of the condensate seal is attached to a top of a curb. The sliding surface plate is laid over the wall member of the condensate seal. A top of the sliding surface plate is attached to a wall with a plurality of upper wall fasteners. The curb rail is laid over the curb member and secured to the curb with a plurality of curb fasteners. The base member of the continuous cleat is laid over the curb rail. The plurality of retainer plates are laid over the plurality of expansion openings and secured to the curb with a plurality of second curb fasteners. The wall member of the continuous cleat is secured with a plurality of wall fasteners. The second downward portion of the continuous cleat is retained between the side plate and the retention plate of the formed cap. The attachment flange of the formed cap is attached to the wall with a plurality of third wall fasteners.

An expansion joint having three axes of expansion for roof to roof applications (roof to roof expansion joint) preferably includes a continuous cleat, a formed cap, a curb rail, a Z-curb rail, a condensate seal and a plurality of retainer plates. The continuous cleat includes a base member, a first side member and a second side member. The first side member extends downward from a first edge of the base member and the second side member extends downward from a second edge of the base member. A plurality of spring plates are attached to a top of the base member. The first side member includes a first offset flange extending from a bottom thereof. A plurality expansion slots are formed through the first side member. The second side member includes a second offset flange extending from a bottom thereof. The formed cap includes a base cap member, a first cap side member and a second cap side member. The first cap side member extends downward from a first edge of the base cap member and the second cap side member extends downward from a second edge of the base cap member. The first cap side member is terminated with a first engagement flange. The second cap side member is terminated with a second engagement flange.

The curb rail includes a base curb member, a side curb flange and an angled curb flange. The side curb flange extends downward from a first edge of the base curb member. The angled curb flange extends downward from a second edge of the base curb member. The Z-curb rail includes a Z-curb base member, an angled Z-curb flange, a support member and a support flange. The angled Z-curb flange extends downward from a first edge of the Z-curb base member. The support member extends upward from a second edge of the Z-curb base member. The support flange extends outward from a top of the support member. The Z-curb rail provides vertical support for the continuous cleat. The condensate seal includes a first curb member, a second curb member and an insulation member. The first curb member extends outward from a first side of the insulation member and the second curb member extends outward from a second side of the insulation member. A quantity of insulation is retained in a bottom of the insulation member. Each retainer plate includes opposed angled flanges that extend outward from opposing edges thereof.

The roof to roof expansion joint is preferably installed as follows. The condensate seal is placed between the fixed curb and the free curb. The curb member is attached to a top of the fixed curb with a plurality of curb fasteners. The Z-curb base member is attached to a top of the free curb with a plurality of free curb fasteners. The continuous cleat is placed on top of the Z-curb. The first side member of the continuous cleat is attached to a side of the fixed curb with a plurality of side curb fasteners. The base member of the continuous cleat is secured to the support flange of the Z-curb with a plurality of cleat fasteners. The formed cap is pushed on to the continuous cleat until the first and second engagement flanges receive the first and second offset flanges.

Accordingly, it is an object of the present invention to provide an expansion joint having three axes of expansion for roof to wall and roof to roof applications.

These and additional objects, advantages, features and benefits of the present invention will become apparent from the following specification.

DETAILED DESCRIPTION OF THE PREFERRED EMBODIMENTS

Figure 5:
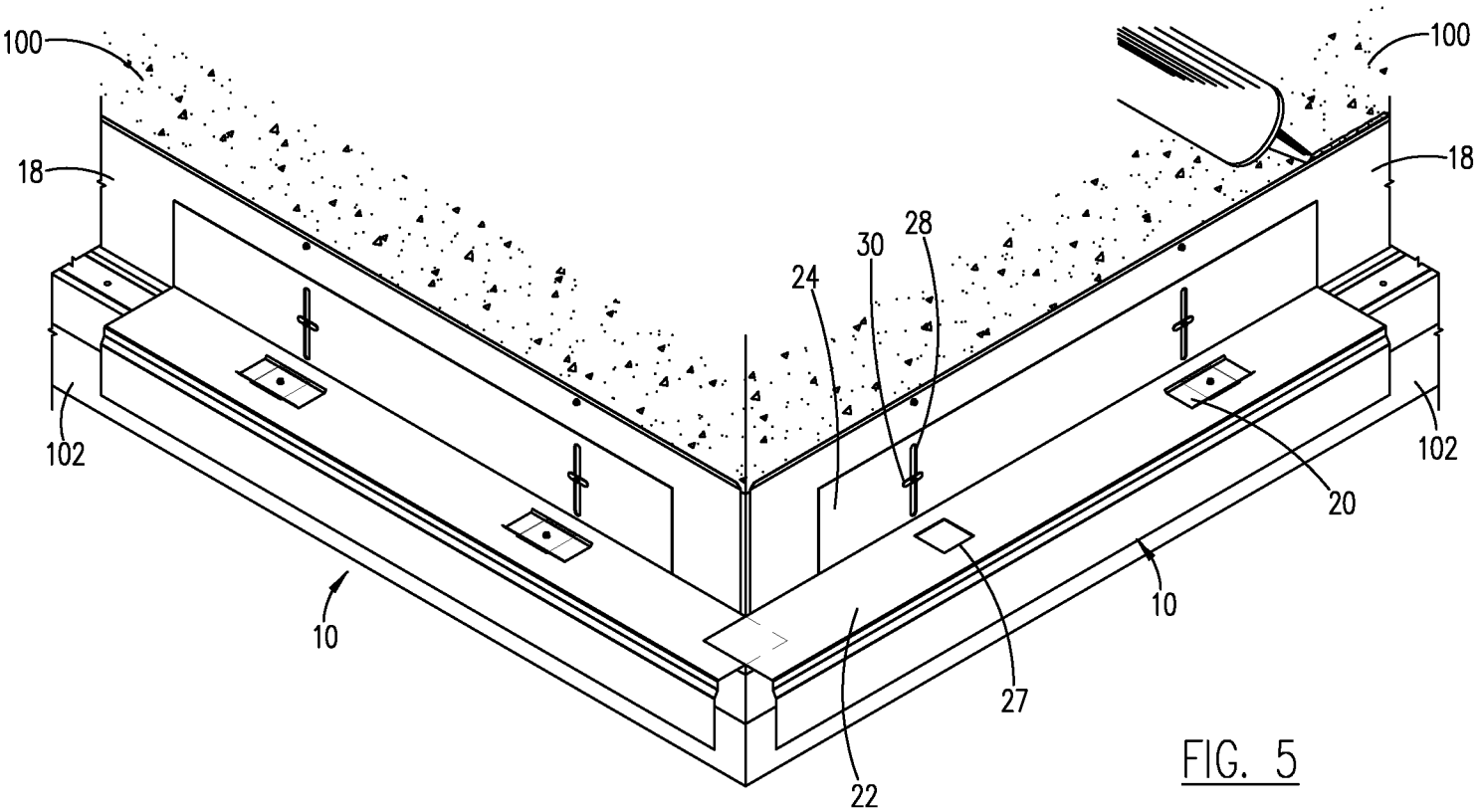
FIG. 5 is a perspective view of an outer wall corner with two continuous cleats engaged with two curb rails and two sliding surface plates of a roof to wall expansion joint in accordance with the present invention.
Figure 6:
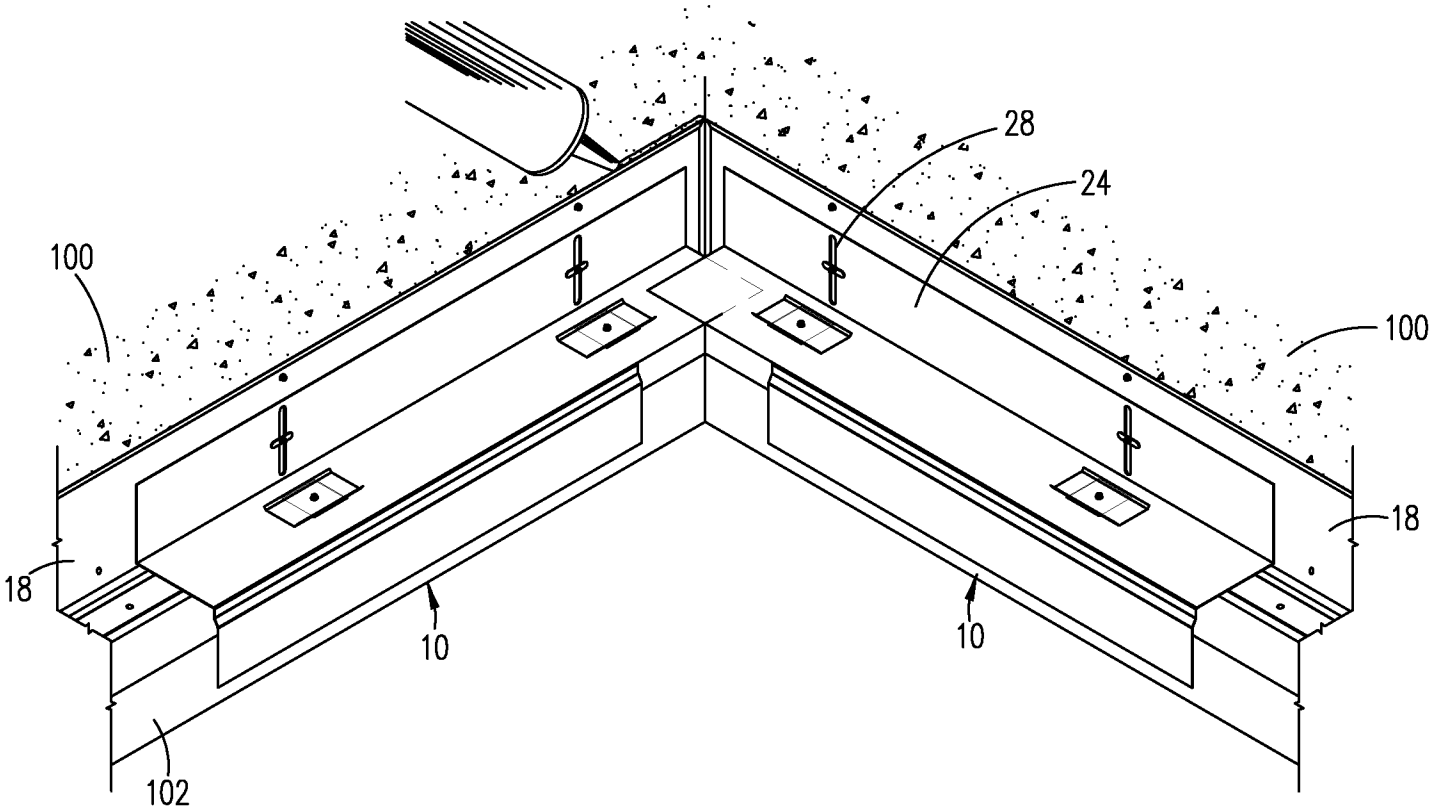
FIG. 6 is a perspective view of an inner wall corner with two continuous cleats engaged with two curb rails and two sliding surface plates of a roof to wall expansion joint in accordance with the present invention.
Figure 9:
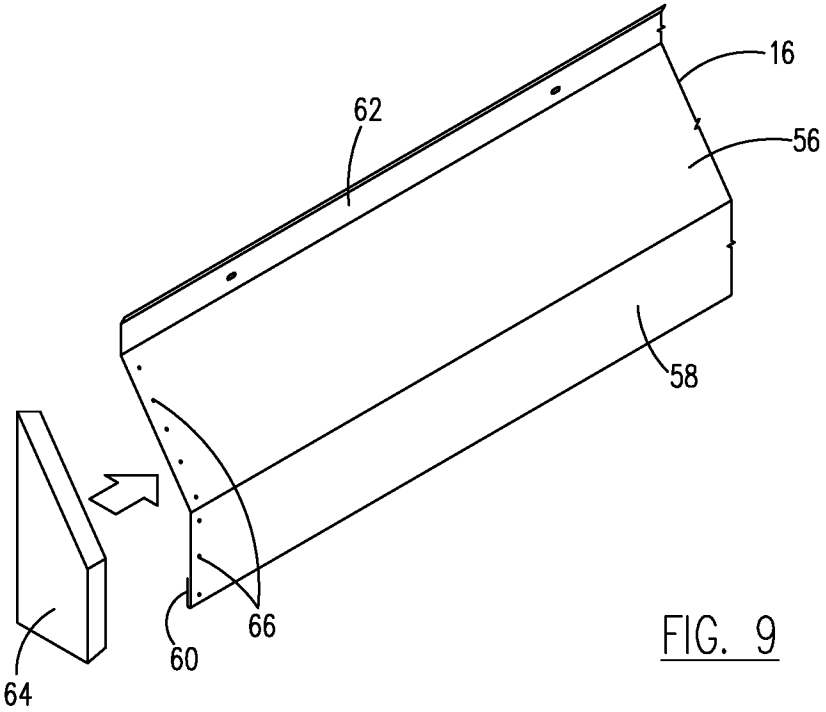
FIG. 9 is an exploded perspective view of an end cap for attachment to an end of a formed cap of a roof to wall expansion joint in accordance with the present invention.
Figure 10:
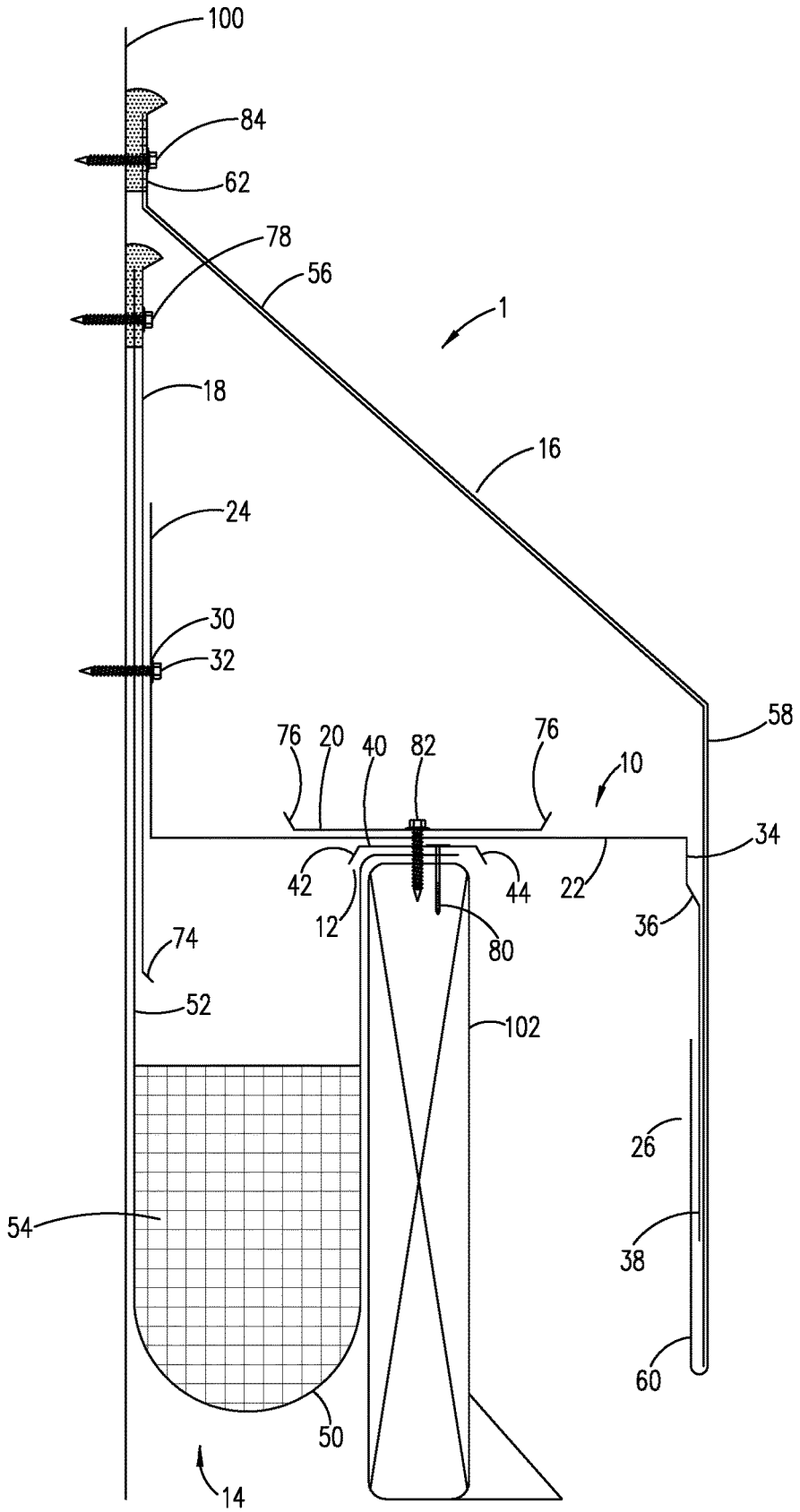
FIG. 10 is an end view of an assembled roof to wall expansion joint in accordance with the present invention.
Figure 12:
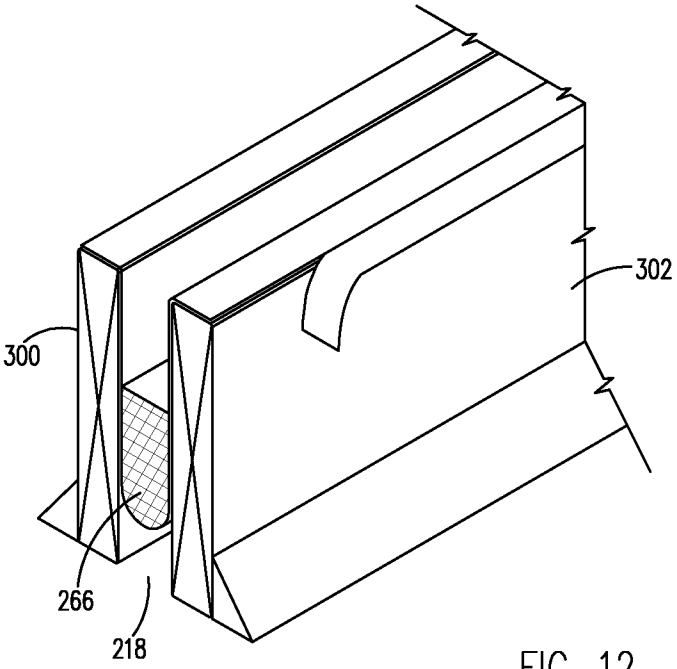
FIG. 12 is a perspective view of a condensate seal installed with a portion of insulation on two adjacent curbs of a roof to roof expansion joint in accordance with the present invention.
Figure 11:
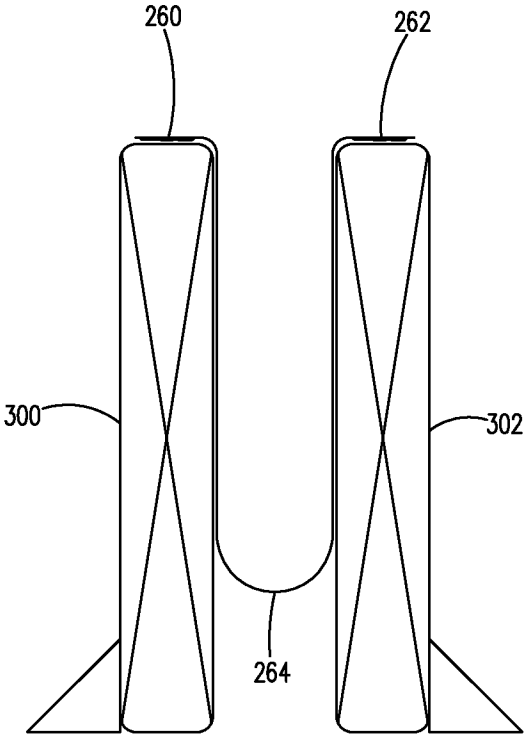
FIG. 11 is an end view of a condensate seal installed on two adjacent curbs of a roof to roof expansion joint in accordance with the present invention.

With reference now to the drawings, and particularly to FIG. 10, there is shown an end view of a roof to wall expansion joint 1. With reference to FIGS. 2-9, the roof to wall expansion joint 1 preferably includes a continuous cleat 10, a curb rail 12, a condensate seal 14, a formed cap 16, a sliding surface plate 18 and a plurality of retainer plates 20. The continuous cleat 10 includes a base member 22, an upward member 24 and a downward member 26. With reference to FIG. 5, a plurality of expansion openings 27 are formed through the base member 22. The upward member 24 extends upward from one edge of the base member 22 and the downward member 26 extends downward from an opposing edge of the base member 22. A plurality of expansion slots 28 are formed in the upward member 24. A shoulder washer 30 covers each expansion slot 28 and is secured to a wall 100 with a wall fastener 32 to slidably engage the upward member 24 with the wall 100.

The downward member 26 includes a first downward portion 34, an offset portion 36 and a second downward portion 38. The first downward portion 34 extends downward from the opposing edge of the base member 22. One end of the offset portion 36 extends downward from a bottom of the first downward portion 34 and a top of the second downward portion 38 extends downward from a bottom of the offset portion 36. The curb rail 12 includes a curb base member 40, a first downward turned flange 42 and a second downward turned flange 44. The first downward turned flange extends 42 downward from one side of the curb base member 40 and the second down turned flange 44 extends downward from an opposing side of the curb base member 40.

Figure 2:
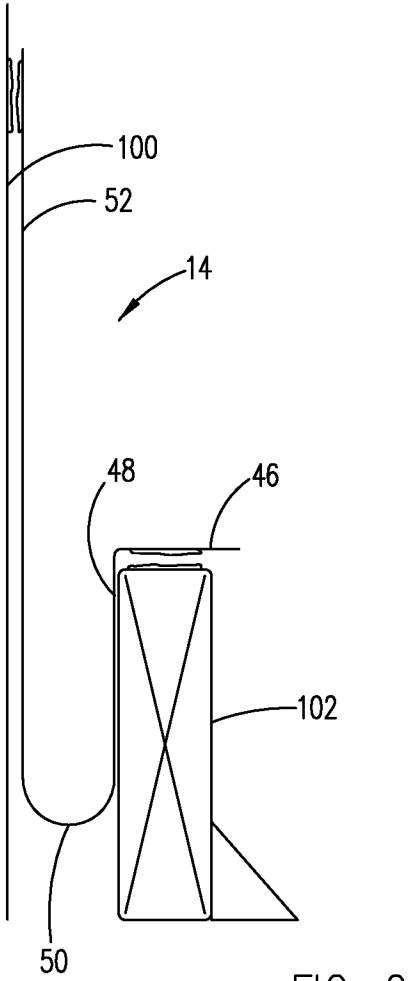
FIG. 2 is an end view of a condensate seal installed on a wall and curb of a roof to wall expansion joint in accordance with the present invention.
Figure 1:
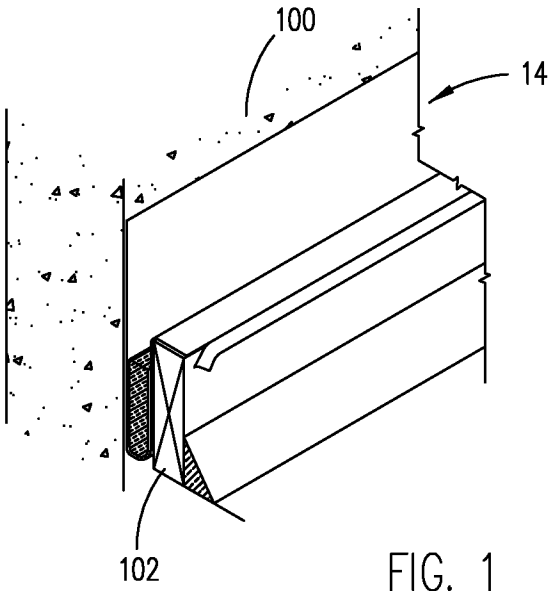
FIG. 1 is a perspective view of a condensate seal installed on a wall and curb of a roof to wall expansion joint in accordance with the present invention.
Figure 4:
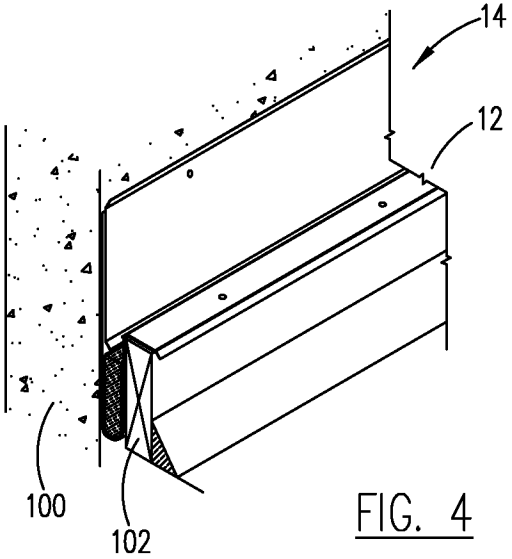
FIG. 4 is a perspective view of a curb rail and a sliding surface plate placed over a condensate seal of a roof to wall expansion joint in accordance with the present invention.

With reference to FIG. 2, the condensate seal 14 includes a seal base 46, a curb member 48, an insulation member 50 and a wall member 52. The wall member 52 extends upward from one side of the insulation member 50 and the curb member 48 extends upward from an opposing side of the insulation member 50. The seal base 46 extends outward from a top of the curb member 48. The insulation member 50 is filled with insulation 54. The formed cap 16 includes a cover plate 56, a side plate 58, a retention flange 60 and an attachment flange 62. The cover plate 56 extends upward from a top of the side plate 58 at an acute angle. The retention flange 62 extends upward from a bottom of the side plate 58. The second downward portion 38 is retained between the retention flange 60 and the side plate 58. The attachment flange 62 extends vertically from a top of the cover plate 56. With reference to FIG. 9, an end cap 64 is sized to be received by an open end of the formed cap 16. A plurality of holes 66 are formed through one end of the formed cap 16 to receive fasteners (not shown) to secure the formed cap 16 to the end cap 64.

Figure 3:
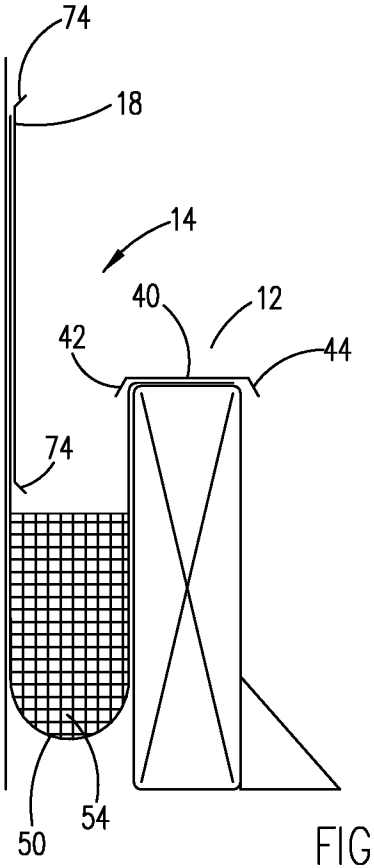
FIG. 3 is a side view of a curb rail and a sliding surface plate placed over a condensate seal of a roof to wall expansion joint in accordance with the present invention.
Figure 7:
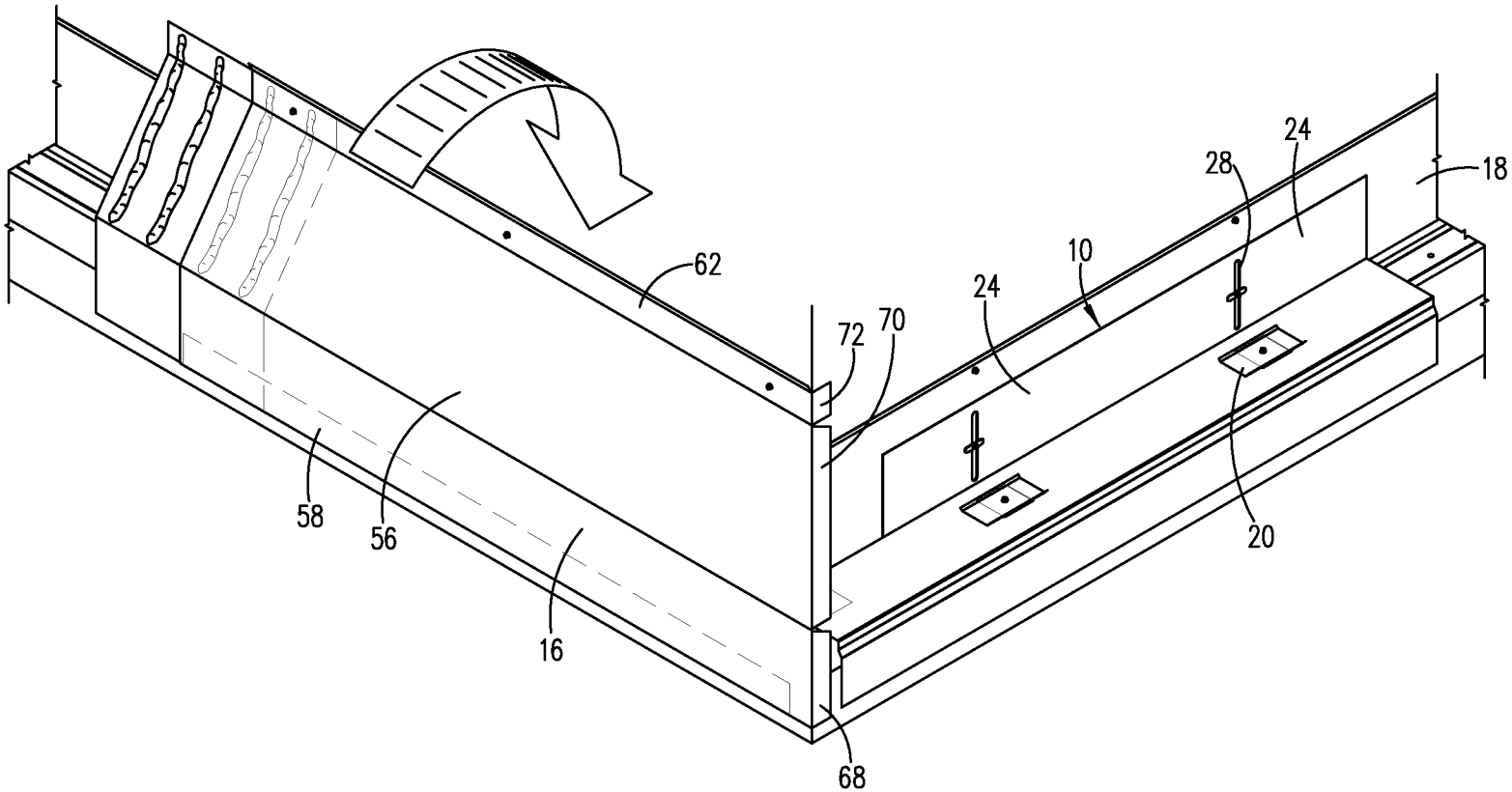
FIG. 7 is a perspective view of an outer wall corner with a formed cap engaged with one of two continuous cleats and attached to a wall of a roof to wall expansion joint in accordance with the present invention.
Figure 8:
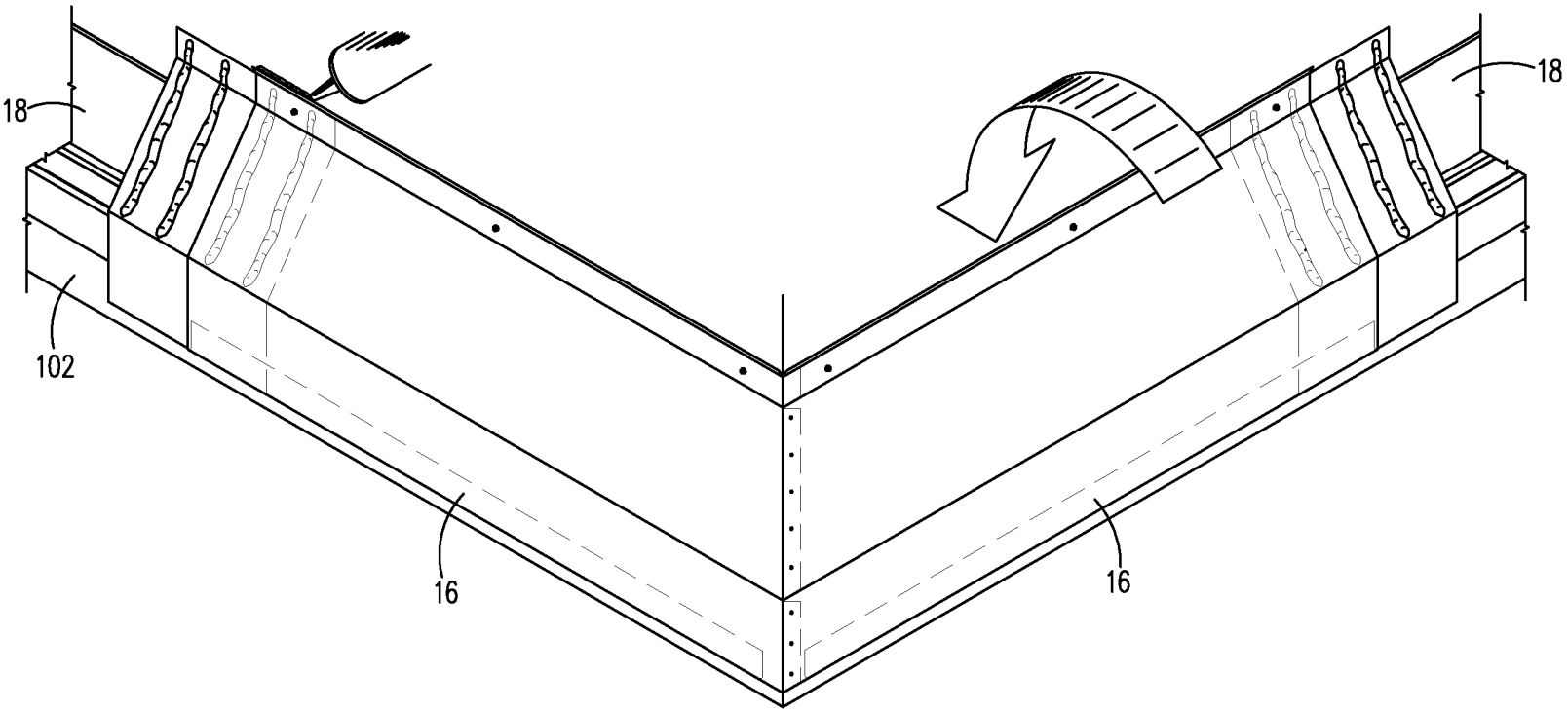
FIG. 8 is a perspective view of an outer wall corner with a second formed cap engaged with a second continuous cleat and attached to a second wall of a roof to wall expansion joint in accordance with the present invention.

FIG. 7 illustrates outer corner applications. A side flange 68 extends perpendicular from one end of the side plate 58; a cover flange 70 extends perpendicular from one end of the cover plate 56; and an attachment flange 72 extends perpendicular from one end of the attachment flange 62. With reference to FIG. 3, the sliding surface plate 18 includes an angled flange 74 that extends outward from a top and bottom thereof. Each retainer plate 20 includes opposed angled flanges 76 that extend outward from opposing edges thereof.

The roof to wall expansion joint 1 is preferably installed as follows. The seal base 46 of the condensate seal 14 is attached laid over a top of a curb 102. The sliding surface plate 18 is laid over the wall member 52 of the condensate seal 14. A top of the sliding surface plate 18 is attached to a wall 100 with a plurality of upper wall fasteners 78. The curb rail 12 is laid over the seal base 46 and secured to the curb 102 with a plurality of curb fasteners 80. The base member 22 of the continuous cleat 10 is laid over the curb rail 12. The plurality of retainer plates 20 are laid over the plurality of expansion openings 26 and secured to the curb 102 with a plurality of second curb fasteners 82. The wall member 24 of the continuous cleat 10 is secured with the plurality of shoulder washers and wall fasteners 32 in the plurality of expansion slots 28. The second downward portion 38 of the continuous cleat 10 is retained between the side plate 58 and the retention plate 60 of the formed cap 16. The attachment flange 62 of the formed cap 16 is attached to the wall 100 with a plurality of third wall fasteners 84.

With reference to FIGS. 11-24, an expansion joint having three axes of expansion for roof to roof applications (roof to roof expansion joint) 2 preferably includes a continuous cleat 210, a formed cap 212, a curb rail 214, a Z-curb rail 216, a condensate seal 218 and a plurality of retainer plates 220. The continuous cleat 210 includes a base member 222, a first side member 224 and a second side member 226. The first side member 224 extends downward from a first edge of the base member 222 and the second side member 226 extends downward from a second edge of the base member 222. A plurality of slide openings 225 are formed through the base member 222, such that the continuous cleat may slide axially relative to the Z-curb rail 216, utilizing the retainer plate 220 and a cleat fastener 276.

A plurality of spring plates 228 are attached to a top of the base member 222. The first side member 224 includes a first offset flange 230 extending from a bottom thereof. A plurality vertical expansion slots 232 are formed through the first side member 224. The second side member 226 includes a second offset flange 234 extending from a bottom thereof. The formed cap 212 includes a base cap member 236, a first cap side member 238 and a second cap side member 240. The first cap side member 238 extends downward from a first edge of the base cap member 236 and the second cap side member 240 extends downward from a second edge of the base cap member 236. A bottom of the first cap side member 238 is terminated with a first engagement flange 242. A bottom of the second cap side member 240 is terminated with a second engagement flange 244.

Figure 13A:
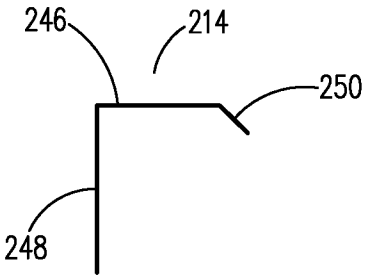
FIG. 13*a* is an end view of a curb rail of a roof to roof expansion joint in accordance with the present invention.
Figure 13B:
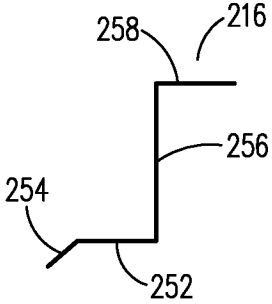
FIG. 13*b* is an end view of a Z-curb rail of a roof to roof expansion joint in accordance with the present invention.
Figure 13:
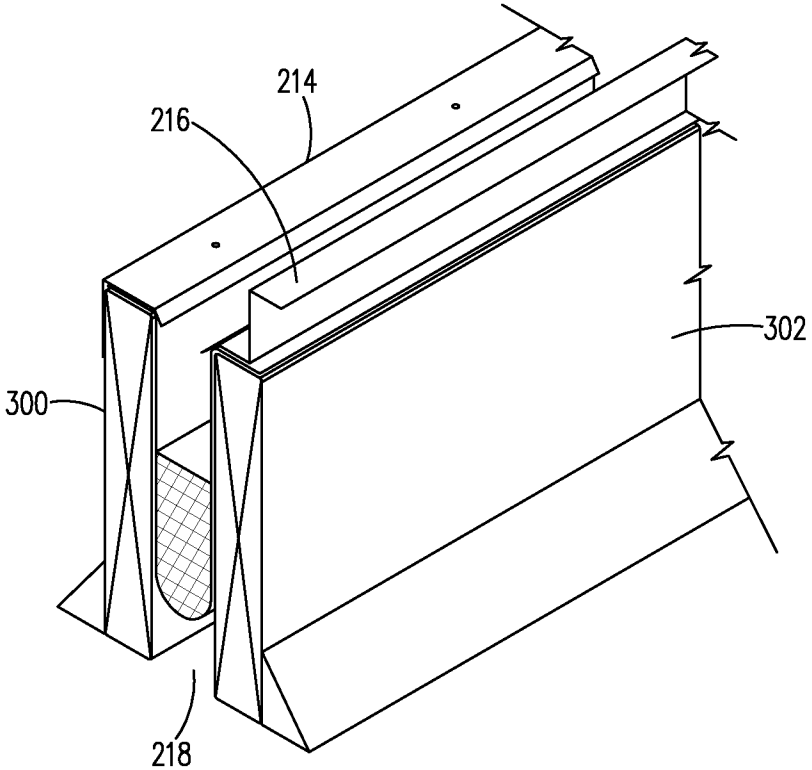
FIG. 13 is a perspective view of a curb rail and a Z-curb rail attached to a top of fixed and free curbs of a roof to roof expansion joint in accordance with the present invention.
Figures 14, 15:
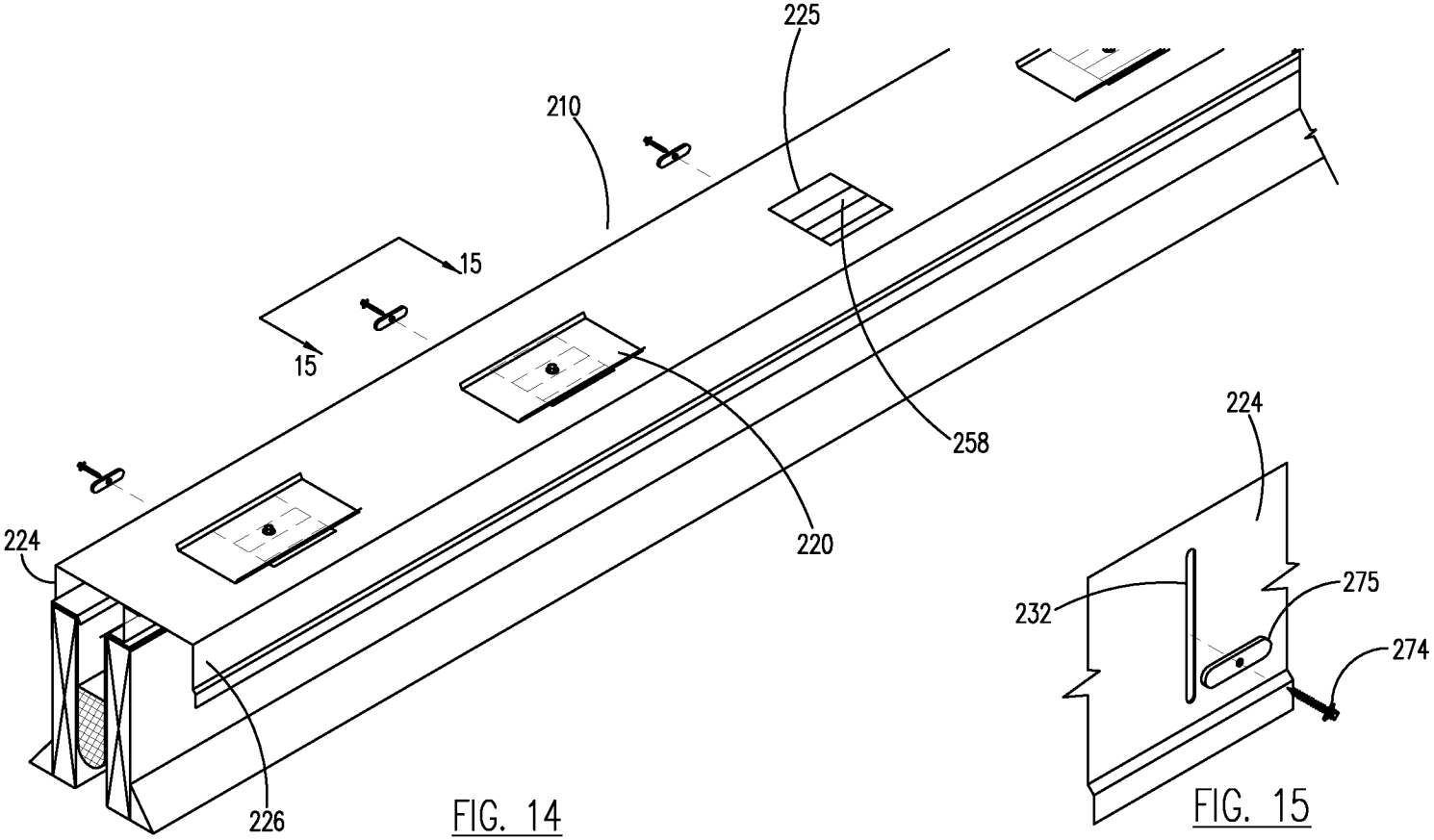
FIG. 14 is a perspective view of a continuous cleat attached to a fixed curb and a Z-curb rail of a roof to roof expansion joint in accordance with the present invention.
FIG. 15 is a partially exploded perspective view taken from FIG. 14 of a fastener and a washer before attachment to a fixed curb to slidably retain a continuous cleat relative to the fixed curb of a roof to roof expansion joint in accordance with the present invention.

With reference to FIG. 13*a*, the curb rail 214 includes a base curb member 246, a side curb flange 248 and an angled curb flange 250. The side curb flange 248 extends downward from a first edge of the base curb member 246. The angled curb flange 250 extends downward from a second edge of the base curb member 246. With reference to FIG. 13*b*, the Z-curb rail 216 includes a Z-curb base member 252, an angled Z-curb flange 254, a support member 256 and a support flange 258. The angled Z-curb flange 254 extends downward from a first edge of the Z-curb base member 252. The support member 256 extends upward from a second edge of the Z-curb base member 252. The support flange 258 extends outward from a top of the support member 256. The condensate seal 218 includes a first curb member 260, a second curb member 262 and an insulation member 264. The first curb member 260 extends outward from a first side of the insulation member 264 and the second curb member 262 extends outward from a second side of the insulation member 264. A quantity of insulation 266 is retained in a bottom of the insulation member 264. Each retainer plate 220 includes opposed angled flanges 268 that extend outward from opposing edges thereof.

Figures 16, 17:
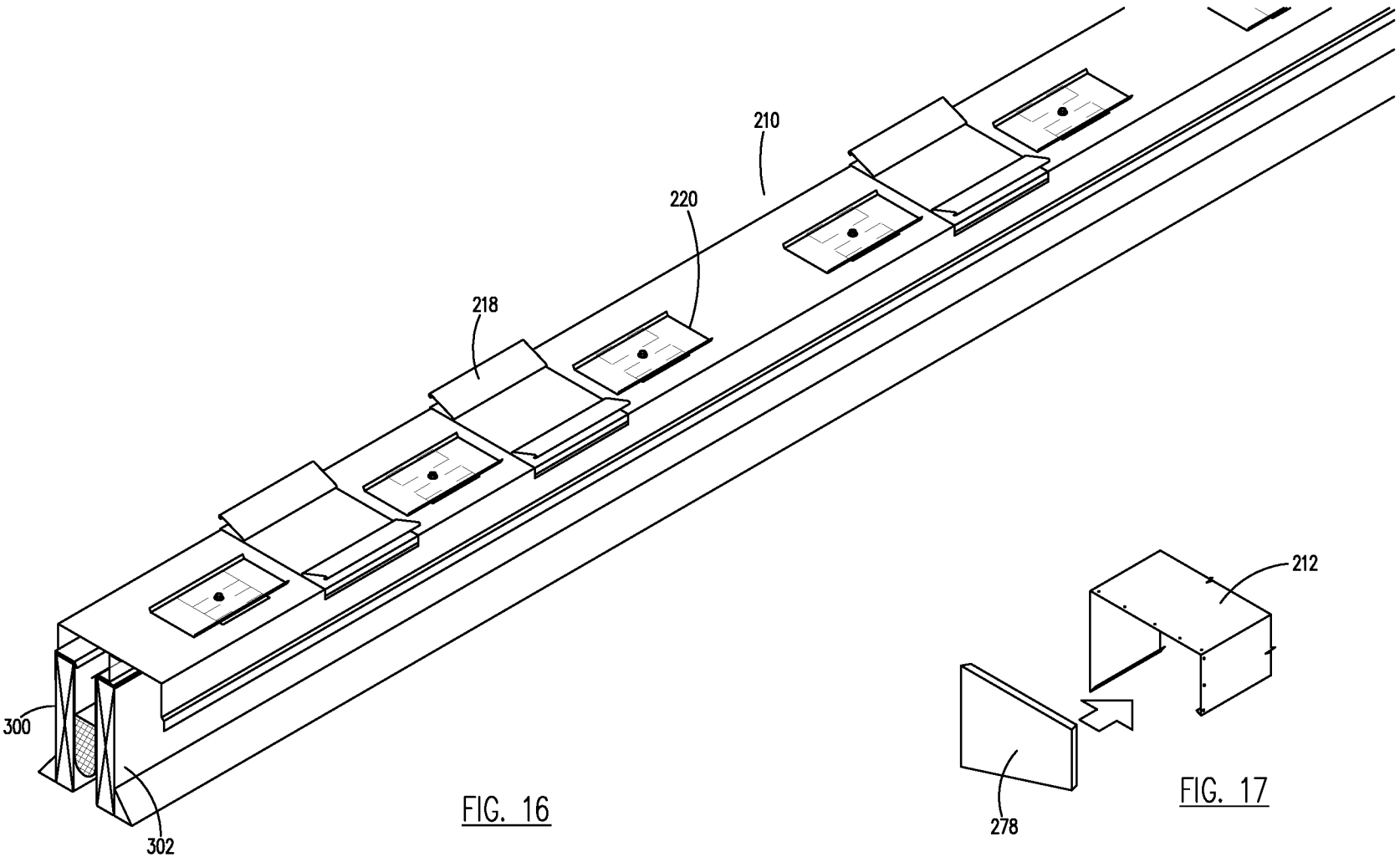
FIG. 16 is a perspective view of a plurality of spring plates attached to a top of a continuous cleat of a roof to roof expansion joint in accordance with the present invention.
FIG. 17 is an exploded perspective view of an end cap relative to a formed cap of a roof to roof expansion joint in accordance with the present invention.
Figure 18:
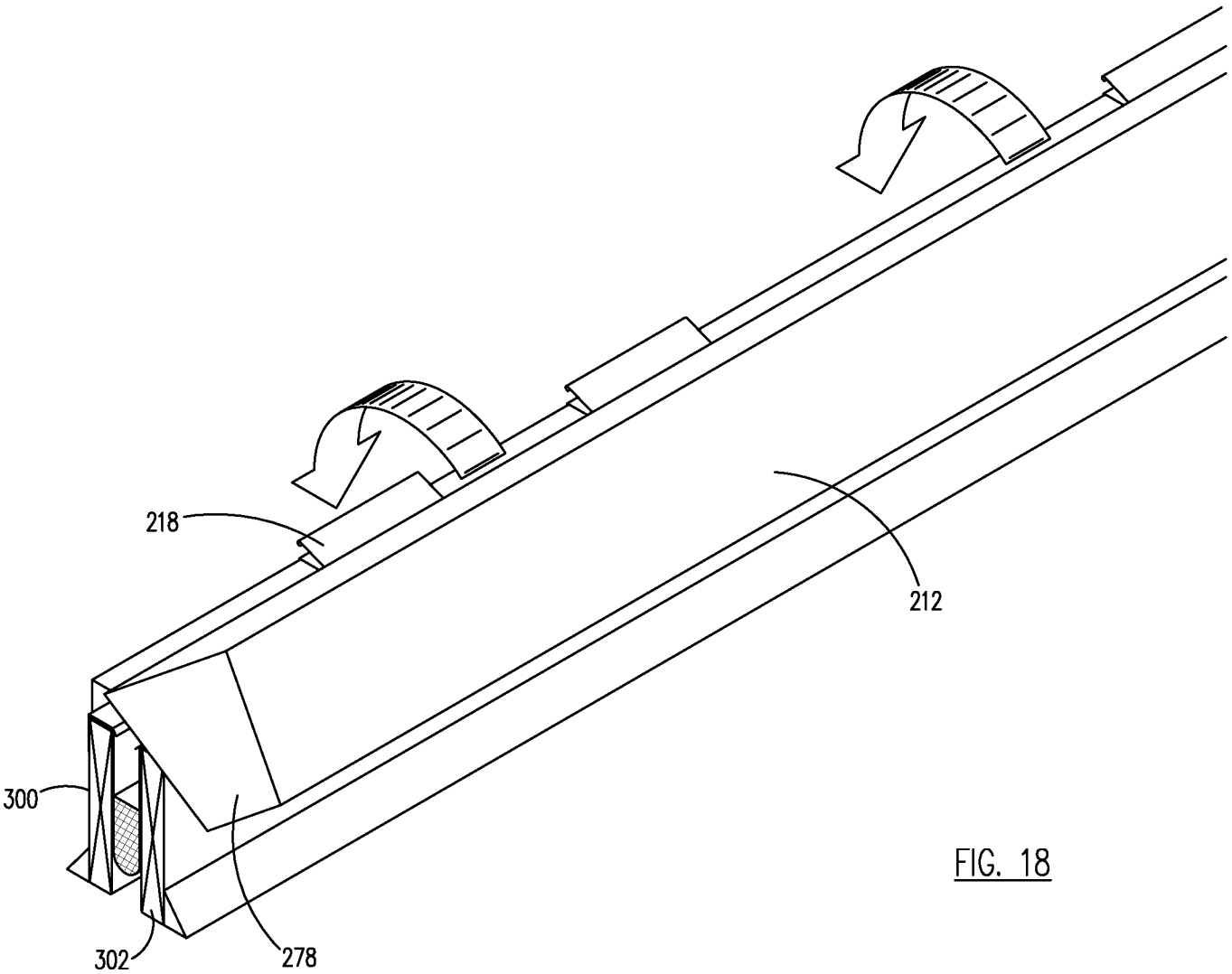
FIG. 18 is a perspective view of a formed cap being attached to a continuous cleat of a roof to roof expansion joint in accordance with the present invention.
Figure 20:
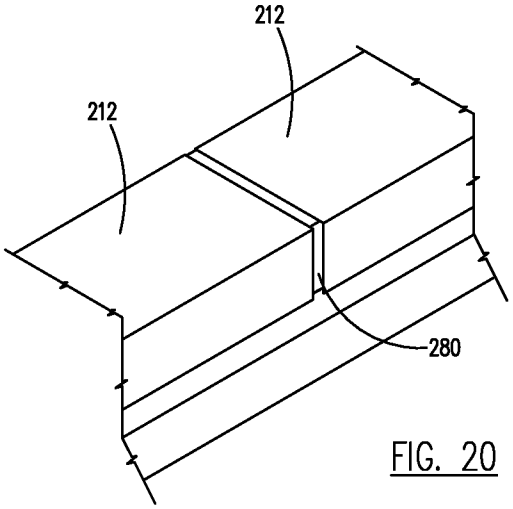
FIG. 20 is a perspective view of a cap splice attached to a continuous cleat with two formed caps attached to the continuous cleat of a roof to roof expansion joint in accordance with the present invention.
Figure 19:
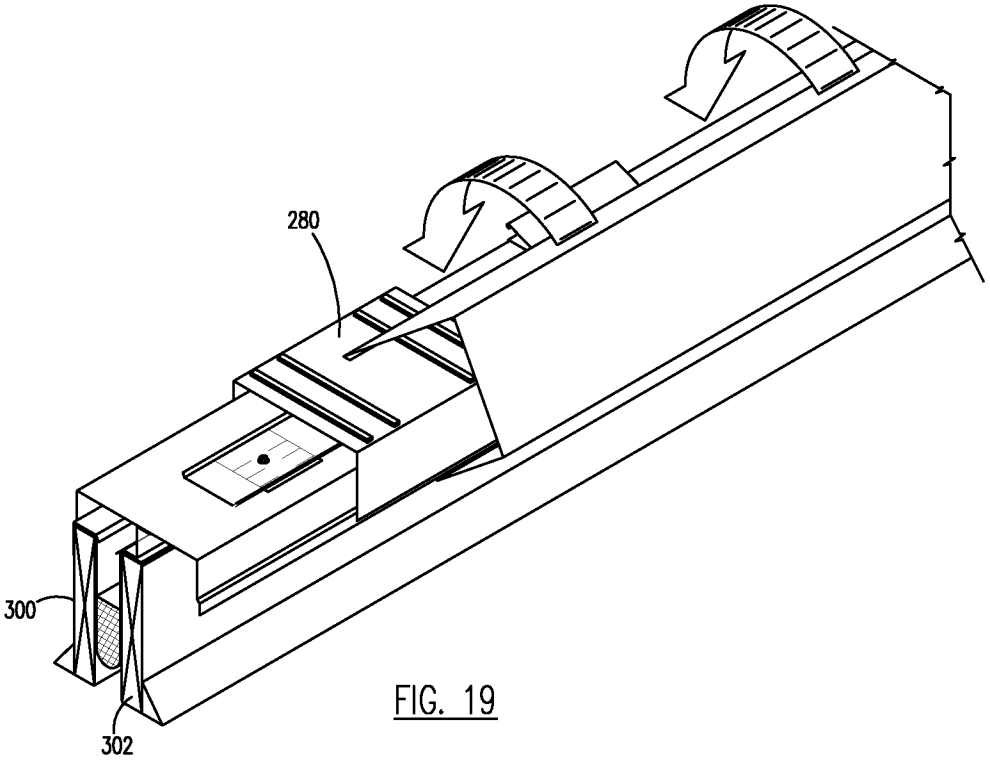
FIG. 19 is a perspective view of a formed cap being attached to a continuous cleat with a cap splice on one end thereof of a roof to roof expansion joint in accordance with the present invention.
Figure 21:
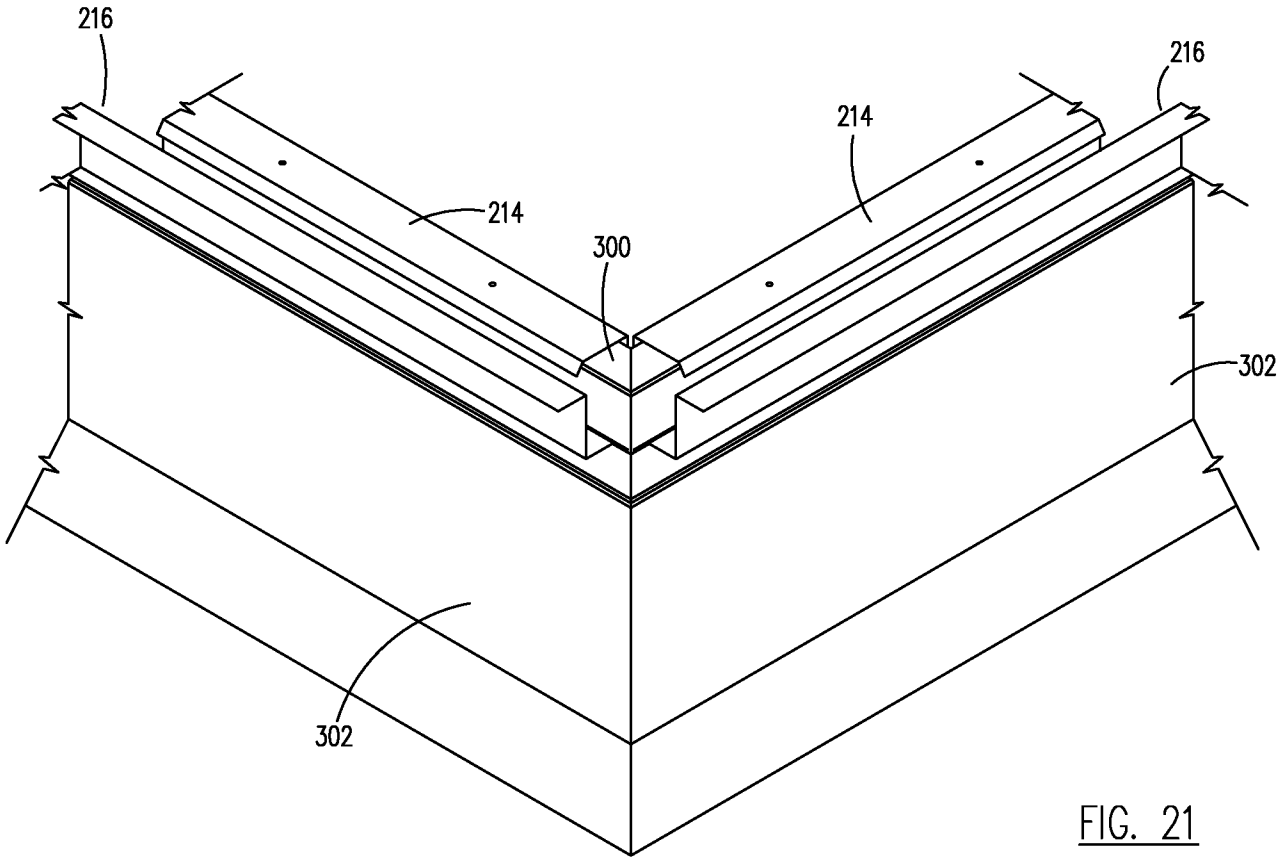
FIG. 21 is a perspective view of two curb rails and a Z-curb rails attached to two corner fixed and free curbs of a roof to roof expansion joint in accordance with the present invention.
Figure 22:
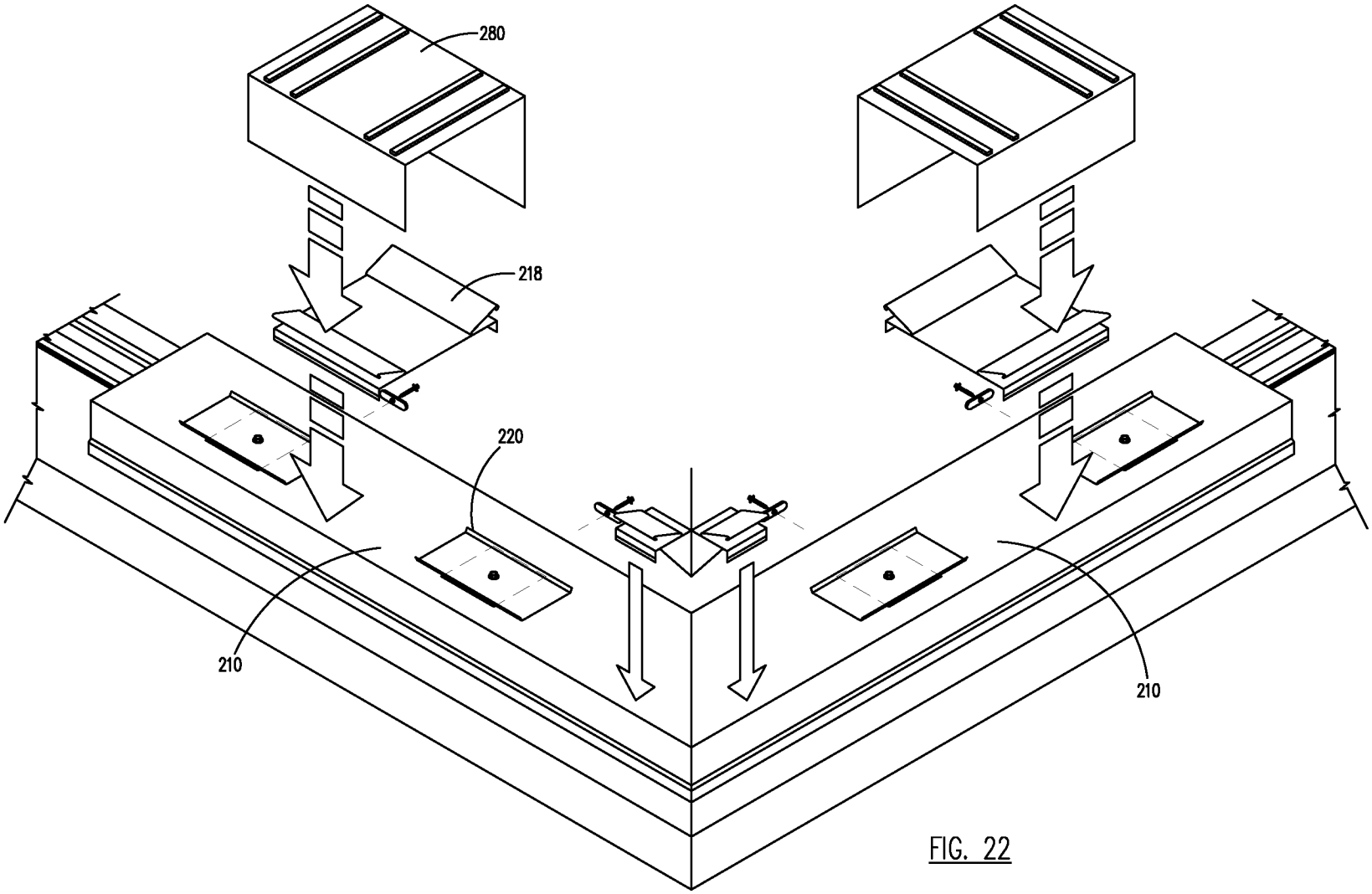
FIG. 22 is a partially exploded perspective view of spring plates, cap splices and two continuous cleats attached to a corner fixed curb and to two Z-curb rails of a roof to roof expansion joint in accordance with the present invention.
Figure 23:
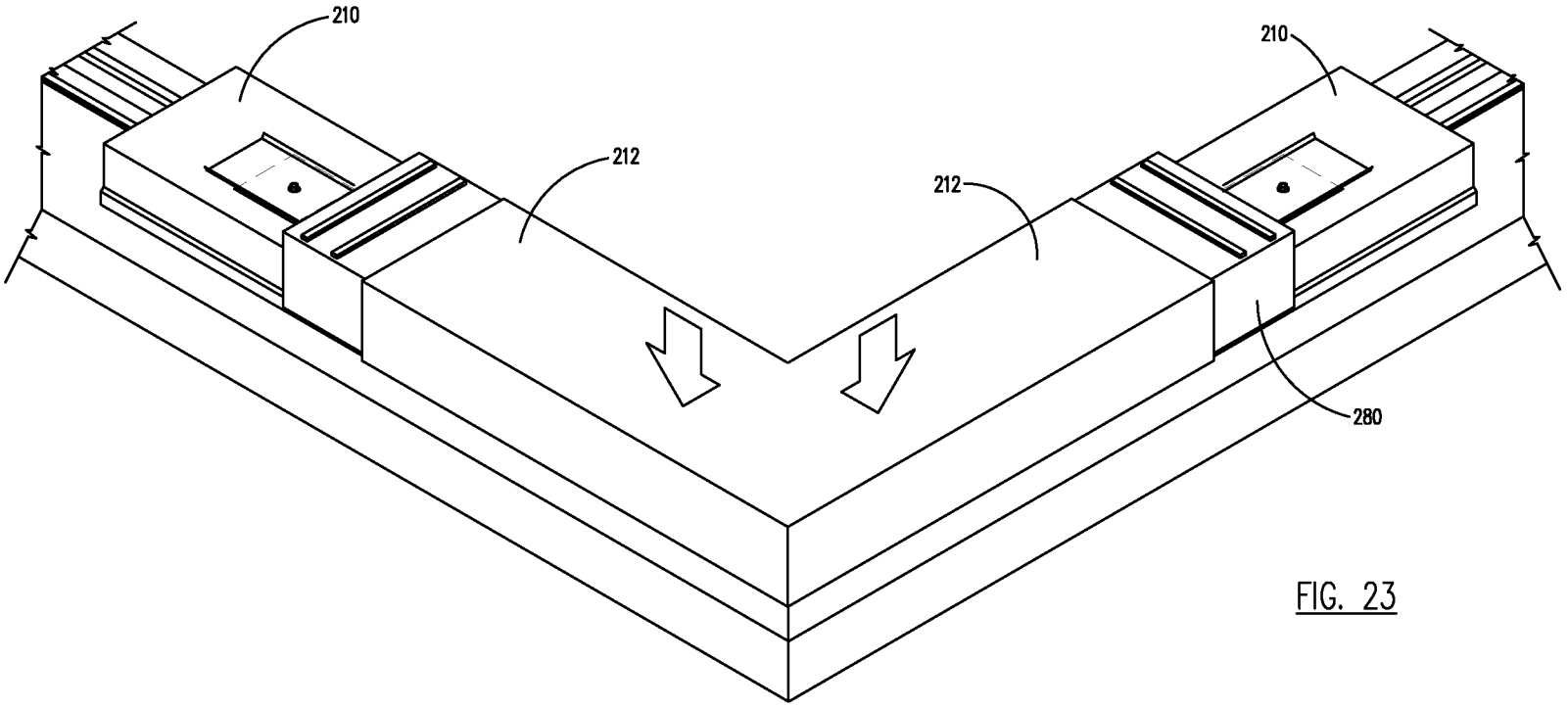
FIG. 23 is a perspective view of two formed caps attached to two continuous cleats in FIG. 22 of a roof to roof expansion joint in accordance with the present invention.
Figure 24:
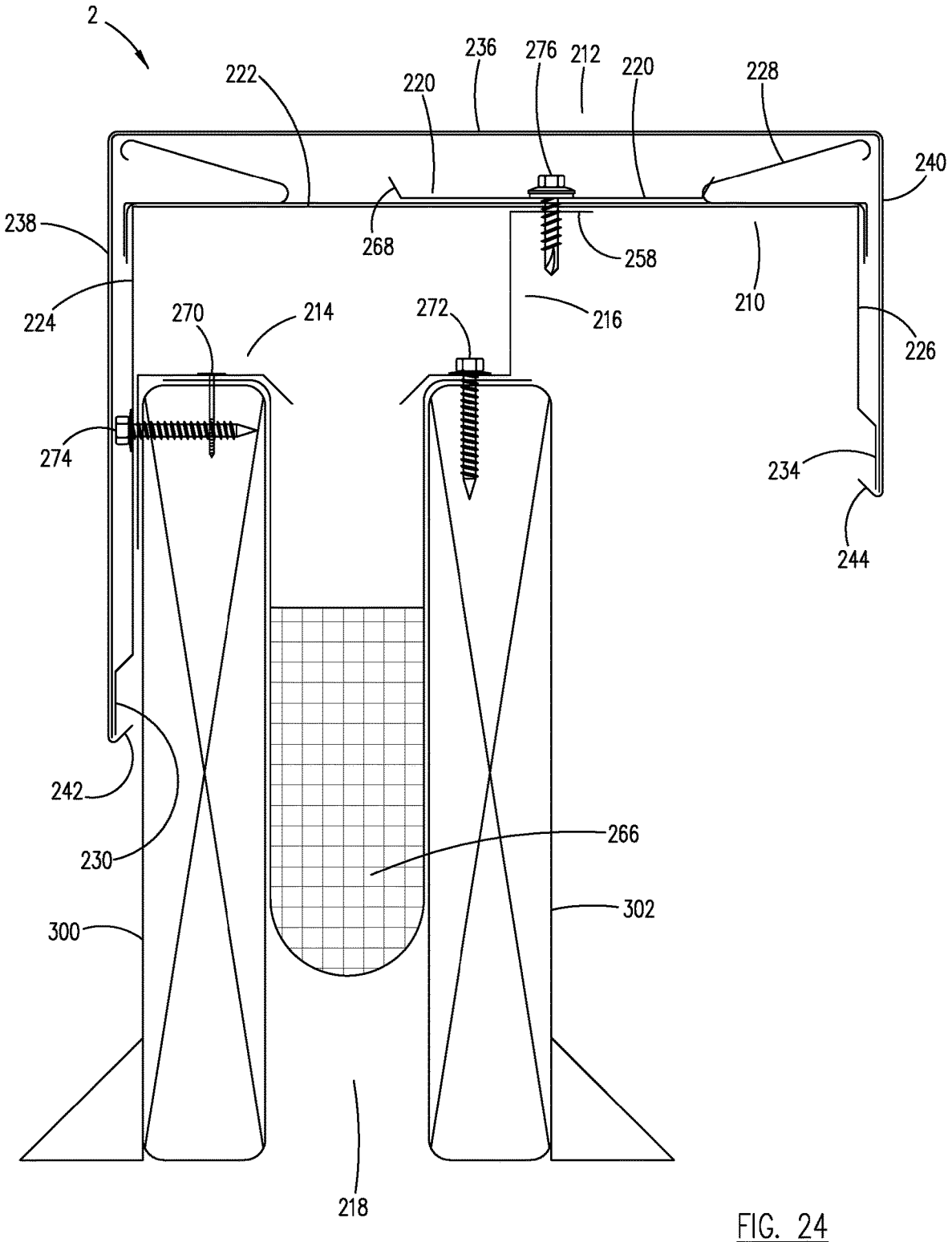
FIG. 24 is an end view of an assembled roof to roof expansion joint in accordance with the present invention.

The roof to roof expansion joint 2 is preferably installed as follows. The condensate seal 218 is placed between a fixed curb 300 and a free curb 302. The curb member 214 is attached to a top of the fixed curb 300 with a plurality of curb fasteners 270. The Z-curb base member 216 is attached to a top of the free curb 302 with a plurality of free curb fasteners 272. The continuous cleat 210 is placed on top of the Z-curb 216. The first side member 224 of the continuous cleat 210 is slidably engaged with a side of the fixed curb 300 with a plurality of side curb fasteners 274 and fastener washers 275. The base member 222 of the continuous cleat 210 is secured to the support flange 258 of the Z-curb 216 with the plurality of cleat fasteners 276. The formed cap 212 is pushed on to the continuous cleat 210 until the first and second engagement flanges 242, 244 receive the first and second offset flanges 230, 234. With reference to FIG. 17, an end of the formed cap 212 may be terminated with an end cap 278. With references to FIGS. 19-20, a cap splice 280 may be used to form a seal between two adjacent formed caps 212.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A first roof to a second roof expansion joint having three axes of expansion, the first roof includes a fixed curb, the second roof includes a free curb, said expansion joint comprising:

a Z-curb rail includes a Z-curb base member and a support flange, said Z-curb base member is attached to the free curb; and a continuous cleat includes a base member, a first side member and a second side member, said first side member extends downward from a first edge of said base member, said second side member extends downward from a second edge of said base member, said first side member is slidably engaged in a vertical axis with the fixed curb, said base member is slidably engaged in a horizontal plane with said support flange of said Z-curb with the free curb in two different axes.

2. The first roof to a second roof expansion joint having three axes of expansion of claim 1, further comprising:

a plurality of expansion openings are formed through said base member; and a plurality of retainer plates are positioned over said plurality of expansion openings, wherein a plurality of cleat fasteners are inserted through said plurality of retainer plates and secured relative to said support flange of said Z-curb rail.

3. The first roof to a second roof expansion joint having three axes of expansion of claim 1 wherein:

said continuous cleat includes a first offset flange that terminates a bottom of said first side member and a second offset flange that terminates a bottom of said second side member.

4. The first roof to a second roof expansion joint having three axes of expansion of claim 3, further comprising:

a formed cap includes a base cap member, a first cap side member and a second cap side member, said first cap side member extends downward from a first edge of said base cap member and said second cap side member extends downward from a second edge of said base cap member, a bottom of said first cap side member is engaged with said first offset flange, a bottom of said second cap side member is engaged with said second offset flange.

5. The first roof to a second roof expansion joint having three axes of expansion of claim 1, further comprising:

a curb rail is attached to the fixed curb, said first side member makes contact with said curb rail.

6. The first roof to a second roof expansion joint having three axes of expansion of claim 4, further comprising:

a plurality of spring plates are attached to said continuous cleat, said spring plate makes contact with said formed cap.

7. The first roof to a second roof expansion joint having three axes of expansion of claim 4 wherein:

a plurality of vertical expansion slots are formed through said first side member.

* * * * *